US005119561A

United States Patent [19]

Olds

[11] Patent Number: 5,119,561

[45] Date of Patent: Jun. 9, 1992

[54] PIVOTED SQEEZE TOOL

[76] Inventor: Allison K. Olds, 494 Ripka St., Philadelphia, Pa. 19128

[21] Appl. No.: 649,873

[22] Filed: Jan. 28, 1991

[51] Int. Cl.[5] ..... B26B 13/12; B26B 13/00; B25B 7/00

[52] U.S. Cl. ..... 30/254; 30/239; 7/125

[58] Field of Search ..... 30/238, 239, 244, 254, 30/257, 259, 252; 7/125; 81/300

[56] References Cited

U.S. PATENT DOCUMENTS

| | | | |
|---|---|---|---|
| 20,879 | 7/1858 | Heinisch | 30/239 |
| 142,886 | 9/1873 | Baker | 30/239 |
| 380,331 | 4/1888 | Leslie | 7/125 |
| 3,046,655 | 7/1962 | Sproson | 30/254 |
| 4,150,484 | 4/1979 | Hildebrandt | 30/254 |
| 4,435,901 | 3/1984 | Nishikawa | 30/254 |
| 4,901,440 | 2/1990 | Go et al. | 30/254 |

FOREIGN PATENT DOCUMENTS

| | | | |
|---|---|---|---|
| 17024 | of 1890 | United Kingdom | 30/238 |

*Primary Examiner*—Douglas D. Watts
*Assistant Examiner*—Paul M. Heyrana, Sr.
*Attorney, Agent, or Firm*—Connolly & Hutz

[57] ABSTRACT

A squeeze tool includes a pair of levers pivoted together to form a handle section of each lever on one side of the pivot connection and a work arm on the other side of the pivot connection. Each handle has a gripping portion asymetrically disposed with respect to the central plane of the tool. The gripping portions are angled opposite to each other with their remote ends converging toward each other and the near ends diverging away from each other both longitudinally and transversely. The gripping portion includes a gripping surface which is generally anatomically contoured having an arcuate thickened central portion to improve the gripping comfort and the efficiency of the tool.

12 Claims, 2 Drawing Sheets

PIVOTED SQEEZE TOOL

BACKGROUND OF INVENTION

Various types of pivotal squeeze tools exist. Such tools include, for example, scissors, tweezers, pliers, surgical clamps and various types of shear devices. Each of these tools has in common that the tool is gripped by the user in order to manipulate the tools to perform their working action. The present invention is directed to the structure for such tools and more particularly with the handle structure to maximize comfort in gripping while also improving the efficiency of the tool.

SUMMARY OF INVENTION

An object of this invention is to provide a squeeze tool which fulfills the above needs.

A further object of this invention is to provide such a squeeze tool which includes structure for maximizing comfort and effort of the user while manipulating the tool.

In accordance with this invention the squeeze tool is in the form of a pair of pivotally connected levers. Each lever is divided into a work arm on one side of the pivotal connection and a handle on the opposite side whereby movement of the handles toward and away from each other cause the work arms to move toward and away from or away from and toward each other so as to perform a working operation. The tool has a central plane which extends through the levers transversely through their pivot member. Each of the handles has a gripping portion to be grasped by the user. This angled gripping portion provides the user with a three dimensional surface to hold. The gripping portions of both handles are asymetrically disposed with respect to the central plane. In such an orientation the gripping portions are angled opposite to each other with their remote ends converging toward each other and their near ends diverging away from each other both longitudinally and transversely. This angled gripping portion provides the user with a three dimensional surface to hold. The gripping surface of each gripping portion is generally anatomically contoured with an arcuate thickened central portion to improve the gripping comfort and efficiency of the tool.

In a preferred practice of the invention the tool is a scissors and each gripping portion is in the form of a closed loop. The outer surface of each loop is particularly contoured to accommodate the index finger outside of the loop.

In a further embodiment of this invention which would be particularly useful, for example, for pliers the gripping portion is the segment of a loop rather than being a closed loop.

THE DRAWINGS

DETAILED DESCRIPTION

Figure 5:
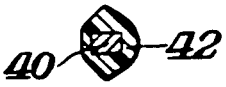
FIG. 5 is a cross-sectional view taken through FIG. 2 along the line 5—5.
Figure 8:
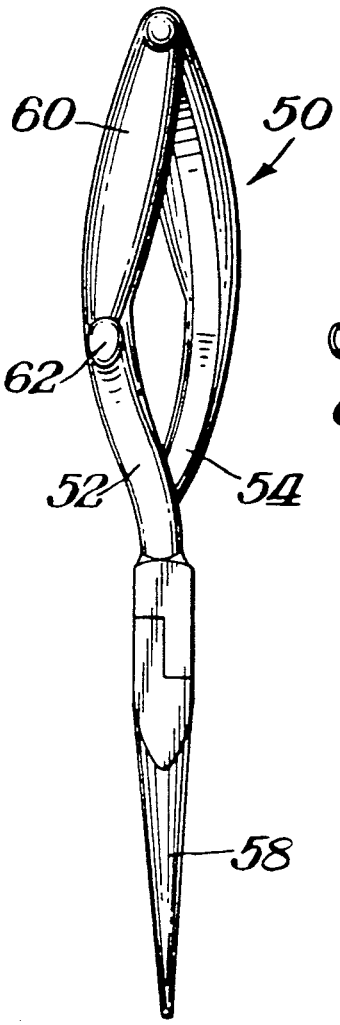
FIG. 8 is a side elevational view of a pliers squeeze tool in accordance with this invention.
Figure 6:
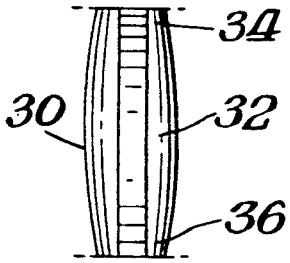
FIG. 6 is a cross-sectional view taken through FIG. 1 along the line 6—6.
Figure 7:
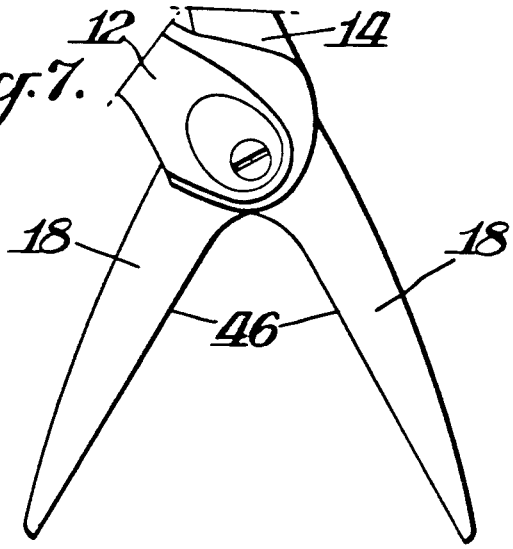
FIG. 7 is a front elevational view of the cutting blades in a modified scissors in accordance with this invention.

The present invention is directed to improvements in squeeze type tools which operate by squeezing handles to manipulate work arms such as by a pivot action. The invention may be used with such tools as scissors, tweezers, pliers, clamps, surgical instruments, staplers and the like. For illustrative purposes FIGS. 1-7 are directed to the form of the invention wherein the tool is a scissors. Such form of the invention could be practiced with various other types of shear tools such as tin snips, gardening shears and the like. FIGS. 7-8 illustrate the concept of the invention used for a clamp type tool.

FIGS. 1-6 illustrate the concept of this invention used on a tool 10 in the form of a scissors. As indicated therein, tool 10 includes a pair of levers 12,14 which are pivotally connected to each other by pin or pivot member 16 so as to divide each lever into a work arm 18 on one side of pivot member 16 and a handle 20 on the other side of pivot member 16. Tool 10 would thus operate in a conventional manner customary with scissors or shears wherein manipulation of the handles 20,20 toward and away from each other causes the work arms or blades 18,18 to move toward and away from or away from and toward each other so as to effect a working operation, namely, the cutting of an object. Tool 10 can also operate wherein the handles 20,20 are manipulated longitudinally and the work arms 18,18 move transversely. When the invention is used with a scissors or shears, the work arms or blades 18,18 would be offset from each other so that the cutting edges 22 of each blade 18 would slide past its corresponding cutting edge and thereby effect the cutting operation. Any suitable pivot means may be used as pivot member 16, such as a bolt or a pin having a nut attached thereto.

A critical feature of this invention is in the contouring of each handle 20. As illustrated handle 20 is in the form of a closed loop having a gripping portion 24 connected to a guide portion 26. Gripping portion 24 in turn has a generally flat base surface 28 disposed toward the corresponding base surface on the other handle with a gripping surface 30 merging into base surface 28. Gripping surface 30 is particularly designed to provide maximum comfort to the handle when a user manipulates tool 10.

As illustrated, each handle 20 is designed to have a generous radii in places where it interfaces with portions of the hand that receive the most pressure during use. For example, as illustrated in FIG. 6 gripping surface 30 has a thickened central portion while the surface itself slopes downwardly to generally anatomically conform to the fingers which would be placed around gripping surface 30. This contoured thickened area 32 acts to evenly distribute the pressure over a greater surface area thereby providing comfort which allows the user in turn to apply even more pressure.

Figure 3:
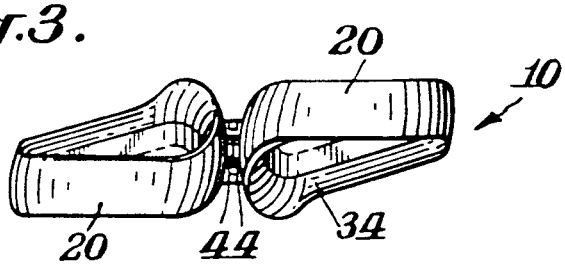
FIGS. 3 and 4 are top and bottom plan views of the squeeze tool shown in FIGS. 1-2.
Figure 2:
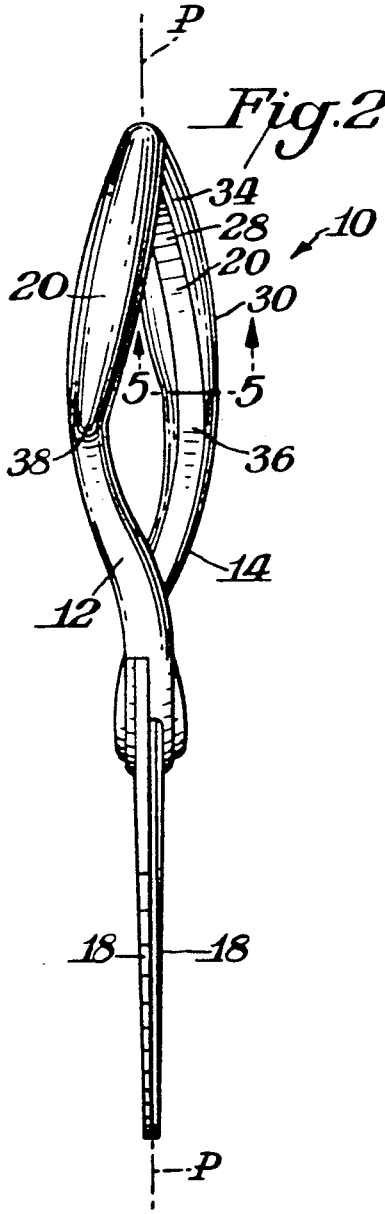
FIG. 2 is a side elevational view of the squeeze tool shown in FIG. 1.
Figure 4:
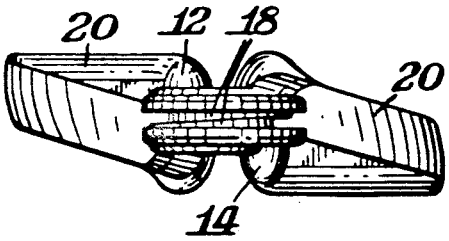

Another feature of this invention is the orientation of the gripping portions 24. As indicated in FIG. 2 tool 10 may be considered as having a central plane P which extends through levers 12,14 perpendicular or transverse to pivot member 16. Plane P may be considered as a reference to illustrate that the gripping portions 24,24 are so curved or oriented with respect to each other and with respect to plane P as to provide improved efficiency and comfort while using the shearing tool 10. For example, as best illustrated in FIGS. 2-3, the gripping portion 24 is asymetrically disposed with respect to each other. The gripping portions 24,24 are angled opposite rather than parallel to each other. The remote ends 34 of the gripping portions converge toward each other while the near ends 36 at the opposite end of each gripping portion diverge away from each other both longitudinally and transversely. The result is a generally twisted gripping portion which is asymmetrical with respect to plane P. The angles resulting from this arrangement operate to place the hand of the user in the most comfortable position for applying pressure. This differs from conventional scissors which force the fingers closer together than they naturally rest and place the fingers in an awkward position for applying pressure. The contour of gripping portions 24, however, maximize finger strength by providing the best leverage for each individual finger. This contour places the handle on the fatty tissue of each finger and not on the joints which makes applying pressure more comfortable. Additionally, this angled configuration places the thumb perpendicular to the handle allowing the thumb to travel a natural path.

Figure 1:
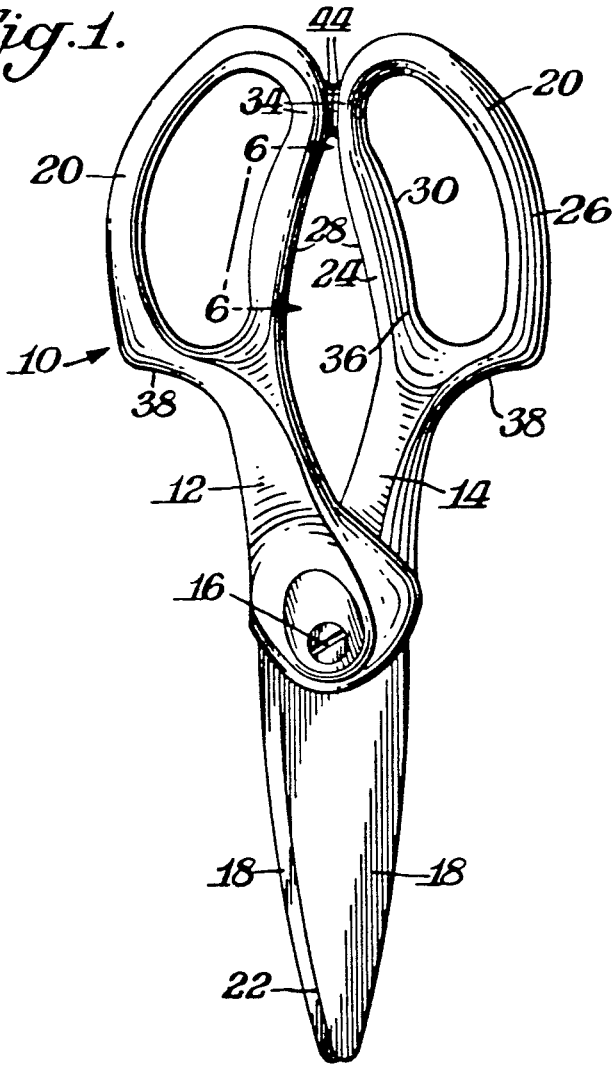
FIG. 1 is a front elevational view of a scissors or shears squeeze tool in accordance with this invention.

As best illustrated in FIG. 1 each loop of handle 20 includes a index finger contour 38 on its outer surface. This aspect of the invention takes into account that the index finger is most comfortable when outside of the loop. The index finger acts as a guiding finger which should be as close to the cutting action as possible. By the provision of index finger contour 38 the index finger can guide the shearing tool during fine manipulations. Index finger contour 38 has a specific concave curve to accommodate the index finger. The curve is rounded for times when pressure is applied. In addition to the physical benefits, the curved design encourages the user to place the finger correctly thereby facilitating proper use. For purposes of visual symmetry an index finger contour is provided on each handle 20. In practice, however, only a single handle need be provided with the index finger contour since the handle used for the thumb side does not require such contour.

Tool 10 may be made of any suitable materials. In the preferred embodiment of this invention the tang or main part of the tool would be made of a material such as metal with a plastic overwrap on the metal. FIG. 5, for example, illustrates the metal tang 40 and plastic overwrap 42. A rigid plastic material, such as could be used for overwrap 42 with fine texture would provide slight friction in the case that the handle 20 is slippery. An elastomeric handle is preferable because it provides a further cushioning at the pressure points. If desired, the elastomeric overwrap 42 may be omitted and the entire tool made from metal, although such version would result in some sacrifice to comfort.

The size and shape of the loop formed for handle 20 would vary. The outer loop or guide portion 26 in theory is not actually necessary for operation of tool 10. Conventionally, however, handles used on scissors have a closed loop to minimize the tendency for the user to inadvertently release a gripping of the handle portions. The actual size of the loop would vary in accordance with the intended use of the tool. For example, larger loops would be used for tin snips and smaller loops would be used for cutting fabric or hair.

For purposes of visual symmetry, the loops for the thumb and fingers are the same. Their needs, however, are different which will generate different loop shapes. For example, the finger loop can be an elongated kidney bean shape 30, providing an arc that folds the contour of the finger joints and the thumb loop can be circular, providing a concave arc for the inner thumb to press against.

As best shown in FIGS. 1 and 3 the point where the loops converge at the rear or remote end 34 of handles 20 include a stop which is in the form of extensions 44 of the tang which are located to abut against each other when the handles are moved toward each other during the pivotal action of levers 12,14. The resulting stop is recessed or thin relative to the loops to prevent the pinching of the skin. If desired, the stops may be molded as part of the plastic handle rather than be exposed metal tangs.

Blades 18 are illustrated in FIG. 1 as being of generally conventional construction. It is to be understood that to achieve the greatest leverage the object being cut should be as close as possible to the pivot point or pivot member 16. In conventional shears, this necessitates opening the shearing tool to its fullest extent reducing the comfort and strength of the hand. If the blades, however, are cut back as illustrated by blades 46 in FIG. 7, there is less overlap and the item being cut can still be as close to the pivot point without opening the tool as far. This will bring the fingers into a more natural condition making them more efficient. As shown each blade 46 is generally aligned with the pivot member to minimize overlapping of blades 46.

As also illustrated the angle of the thumb loop lies perpendicular to the movement of the thumb for the most direct relationship between the thumb and handle. This places the thumb in a natural position to open and close providing comfort and reducing fatigue often associated with prolonged use. This allows the thumb to slide into the loop past the second joint eliminating the possibility of rubbing the joint on the inside loop. Significantly, this also places the internal surface of the loop on the fattest portion of the hand. When shearing with the most force the lower or fatty portion of the thumb serves to stabilize the tool while the fingers squeeze inward. The curve on the finger side of gripping surface 30,30 follows the contour of the finger joints equalizing the pressure applied to each finger.

Figure 9:
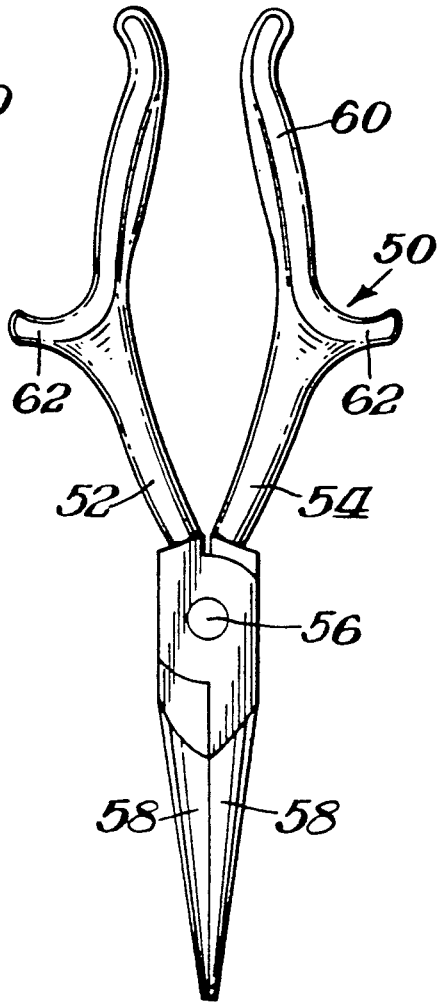
FIG. 9 is a front elevational view of the tool in FIG. 8.

FIGS. 8-9 illustrate the concepts of this invention as applied to a clamp type tool 50. As shown therein, tool 50 includes a pair of levers 52,54 pivotally connected by pivot member 56 whereby each lever includes a work arm 58 and a handle 60. Handle 60 is of the same construction as gripping portion 30. With the pliers type tool 50 a loop section similar to portion 26 is not included but handle 60 also includes index finger contour 62.

The invention may also be practiced by using a partial loop such as handle 60 on a shearing tool rather than a complete loop such as handle 20.

A should be apparent the invention results in a tool which provides a high level of comfort while enabling the user to use the energy more efficiently. The added comfort also permits the user to perform a working task for a longer period of time without fatigue.

What is claimed is:

1. A squeeze tool for operation by a user comprising a pair of levers, a pivot member pivotally connecting said levers to each other, each of said levers being divided into a work arm on one side of said pivot member and a handle on the opposite side of said pivot member whereby movement of said handles toward and away from each other causes said work arms to move toward and away from each other or vice versa to perform a working operation, said tool having a central plane extending through said levers transversely through said pivot member, each of said handles having a gripping portion to be grasped by the user, one of said gripping portions being a finger gripping portion, the other of said gripping portions being a thumb gripping portion, each of said gripping portions being asymmetrically disposed with respect to said central plane, each of said gripping portions having a first end remote from said pivot member and a second end nearer to said pivot member, said gripping portions being angled opposite to each other with said ends of said gripping portions remote from said pivot member converging toward each other and said ends of said gripping portions nearer to said pivot member diverging away from each other longitudinally and transversely, each of said gripping portions having a base surface and a gripping surface merging into said base surface, said base surfaces of said handles being disposed toward each other, said gripping surfaces of said handles being disposed remote from each other, said gripping surface of said finger gripping portion being anatomically contoured with an arcuate sloping central portion which is thicker than the thickness of its said remote end and its said near end to improve the gripping comfort and the efficiency of said tool, and said thumb gripping portion having a thumb supporting surface.

2. The tool of claim 1 including an index finger contour formed on the outer surface of said handle having said finger gripping portion at its near end.

3. The tool of claim 2 including stop members on each of said gripping portions at said remote ends, and said stop members being in the path of motion of each other to prevent said gripping portions from contacting each other.

4. The tool of claim 3 wherein said tool is a shearing tool, said work arms being blades having longitudinal cutting edges, said blades being of a size and shape to be disposed side by side in overlapping relationship when said handles and said blades in their closed position, and at least one of said blades being cut back with its cutting edge generally aligned with said pivot member whereby said blades are in minimal overlapping relationship.

5. The tool of claim 3 wherein each of said handles is in the form of a closed loop, and said index finger contour being the outer surface of its said closed loop.

6. The tool of claim 5 wherein said closed loop of said handle having said finger gripping portion is kidney bean shaped, and said closed loop of said handle having said thumb gripping portion is circularly shaped.

7. The tool of claim 3 wherein each of said handles is in the form of a partial loop.

8. The tool of claim 3 wherein each of said handles is made of a metal material having a plastic overwrap.

9. The tool of claim 8 wherein said stop members are made of said metal extending through said overwrap.

10. The tool of claim 2 wherein said tool is a clamp, and said work arms being in the path of travel of each other.

11. The tool of claim 10 wherein each of said handles is in the form of a partial loop.

12. The tool of claim 2 wherein said index finger contour is concave shaped.

* * * * *